US005127528A

United States Patent [19]

Cone

[11] Patent Number: 5,127,528

[45] Date of Patent: Jul. 7, 1992

[54] EXTENDIBLE ROTARY SHOE RACK

[76] Inventor: Margaret E. Cone, 4414 C Rio Grande St., Kennewick, Wash. 99336

[21] Appl. No.: 654,145

[22] Filed: Feb. 12, 1991

[51] Int. Cl.[5] ..... A47F 5/00

[52] U.S. Cl. ..... 211/34; 211/37; 211/86; 211/163

[58] Field of Search ..... 211/37, 86, 163, 34, 211/33, 196, 205

[56] References Cited

U.S. PATENT DOCUMENTS

| | | | |
|---|---|---|---|
| D. 23,192 | 4/1894 | Landau et al. | 211/37 X |
| 1,810,928 | 6/1931 | Pickop | 211/86 X |
| 2,903,227 | 9/1959 | Key | 211/86 X |
| 2,941,669 | 6/1960 | Palay et al. | 211/163 X |
| 3,018,898 | 1/1962 | Frazelle | 211/86 |
| 3,135,389 | 6/1964 | Farley | 211/37 |
| 3,820,694 | 6/1974 | Pabis | 211/86 X |
| 4,819,817 | 4/1989 | Mar | 211/86 X |

*Primary Examiner*—Robert W. Gibson, Jr.

[57] ABSTRACT

An improved extendible rotary shoe rack (10) for mounting between a lower surface (12) and an upper surface (14). The shoe rack includes a pedestal (16) adapted for placement against the lower surface and an upper mount (18) adapted for placement against the upper surface. A lower tube (20) is rotatably mounted to the pedestal and extends upwardly therefrom. An upper tube (22), having an open end (60) sized to receive a portion of the lower tube and to allow slidable movement therebetween, is rotatably mounted to the upper mount and extends downwardly therefrom. A helical compression spring (26) is disposed within the upper tube to secure the lower and upper tubes together so that they rotate in unison, and to provide a telescoping function by urging the upper mount against the upper surface over a range of upper surface-to-lower surface distances. A plurality of substantially equally spaced shoe support members (24), disposed in a plurality of circumferential rows (66), are attached to the lower tube. The shoe support members of any given circumferenital row are offset relative to the shoe support members of an adjacent row, thereby allowing more shoes (11) to be stored per unit upper surface-to-lower surface distance.

13 Claims, 4 Drawing Sheets

EXTENDIBLE ROTARY SHOE RACK

TECHNICAL FIELD

This invention relates to shoe racks and, more specifically, to a rotatable shoe rack that makes more efficient use of space and is extendible to fit a range of applications.

BACKGROUND OF THE INVENTION

Storage of shoes can occupy a great deal of space, and retrieval of stored shoes can be a very inconvenient process. Accordingly, a variety of purportedly space-saving, convenient-to-use shoe racks have been developed.

One such shoe rack consists of a sprawling frame normally positioned on the floor of the environment of application, the frame having a plurality of support members that support each individual shoe above the floor. Disadvantages of such a shoe rack include being unsightly and consuming valuable floor space (usually closet floor space). Further, such shoe racks are awkward to use because they require the user to bend over, often in cramped quarters, to store or retrieve shoes. Additionally, they are usually positioned in areas that are poorly lit, thereby hampering the user's selection of the desired shoes.

A second type of shoe rack, an over-the-door shoe rack, consists of a frame having a plurality of support members for supporting individual shoes, and a pair of spaced-apart mounting mechanisms coupled to the frame and placed over the top of the door to support the frame as the frame rests against one surface (usually the inside surface) of the door. This over-the-door shoe rack avoids the use of valuable floor space, is easily accessible, and is positioned in an area normally possessing proper lighting. However, this type of shoe rack possesses the disadvantages of being unsightly and of restricting the full range of motion of the door. Further, as the frame swings away from the surface of the door, and back, during opening and closing of the door, the result is the creation of noise and potential damage to the door.

A third type of shoe rack, a rotary shoe rack, consists of a stationary (nonrotatable) pole extending between a lower surface and an upper surface, and a plurality of trays rotatably mounted along the vertical length of the pole. Each tray has a plurality of shoe support members disposed about the periphery of the tray, and a bearing assembly that allows rotation of the tray. While the rotary shoe rack overcomes some of the problems associated with the two aforementioned shoe racks, the rotary shoe rack does possess the disadvantages of being relatively unsightly and of allowing the shoes to dangle from the shoe support members in an unstable fashion. Further, a significant volume of space is required because the shoes are disposed as much as twelve inches away from the pole. Additionally, such a shoe rack is relatively expensive to produce due to the bearing assembly required for each tray.

As a result, there has been a long-felt need for a shoe rack that: (1) is rotatable to provide convenient deposit and retrieval of shoes; (2) is extendible to fit a range of upper surface-to-lower surface applications; (3) is aesthetically pleasing; (4) supports the shoes in a stable manner; (5) is space efficient; and (6) is relatively inexpensive to produce. The present invention is directed to satisfying this need.

SUMMARY OF THE INVENTION

In accordance with this invention, an improved extendible rotary shoe rack for mounting between a lower surface and an upper surface is disclosed. The shoe rack includes a pedestal adapted for placement against the lower surface and an upper mount adapted for placement against the upper surface. A lower tube is rotatably mounted to the pedestal and extends upwardly therefrom; an upper tube is rotatably mounted to the upper mount and extends downwardly therefrom. Biasing means are provided to: (1) secure the lower and upper tubes together so that they rotate in unison; and (2) urge the upper mount against the upper surface over a range of upper surface-to-lower surface distances. A plurality of shoe support members are peripherally attached to either the lower or the upper tube, the shoe support members being disposed in a plurality of circumferential rows.

Preferably, the upper tube has an open end sized to receive a portion of the lower tube such that slidable movement between the tubes is provided, with the shoe support members being attached to the lower tube.

Also preferably, the circumferential rows have an even number of substantially equally spaced shoe support members arranged such that the shoe support members of any given row are offset relative to the shoe support members of an adjacent row, thereby allowing more shoes to be stored per unit upper surface-to-lower surface distance. Namely, a shoe support member of a given row is positioned at the approximate midpoint of a line extending between adjacent shoe support members of an adjacent row.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION OF THE PREFERRED EMBODIMENT

Figure 1:
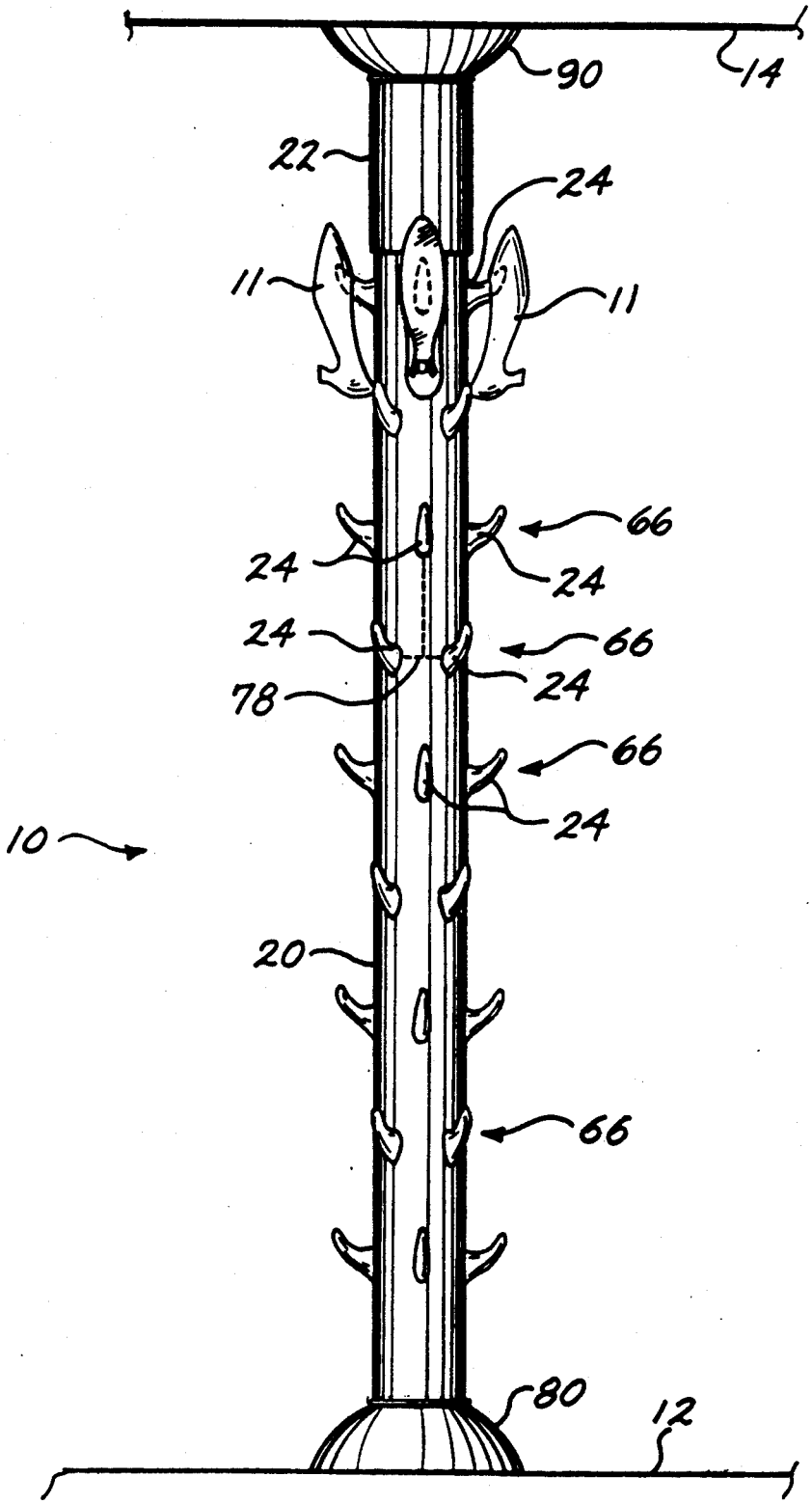
FIG. 1 is an environmental front view of an extendible rotary shoe rack made in accordance with the principles of the present invention.

As illustrated in FIG. 1, an extendible rotary shoe rack 10 formed in accordance with the present invention may be employed for the storage of shoes 11. As shown, the shoe rack 10 is disposed between a lower surface 12 and an upper surface 14. While the shoe rack 10 of the present invention may be disposed between virtually any two surfaces, its application is primarily aimed at closets, utility rooms, bedrooms, basements, etc.

Figure 2:
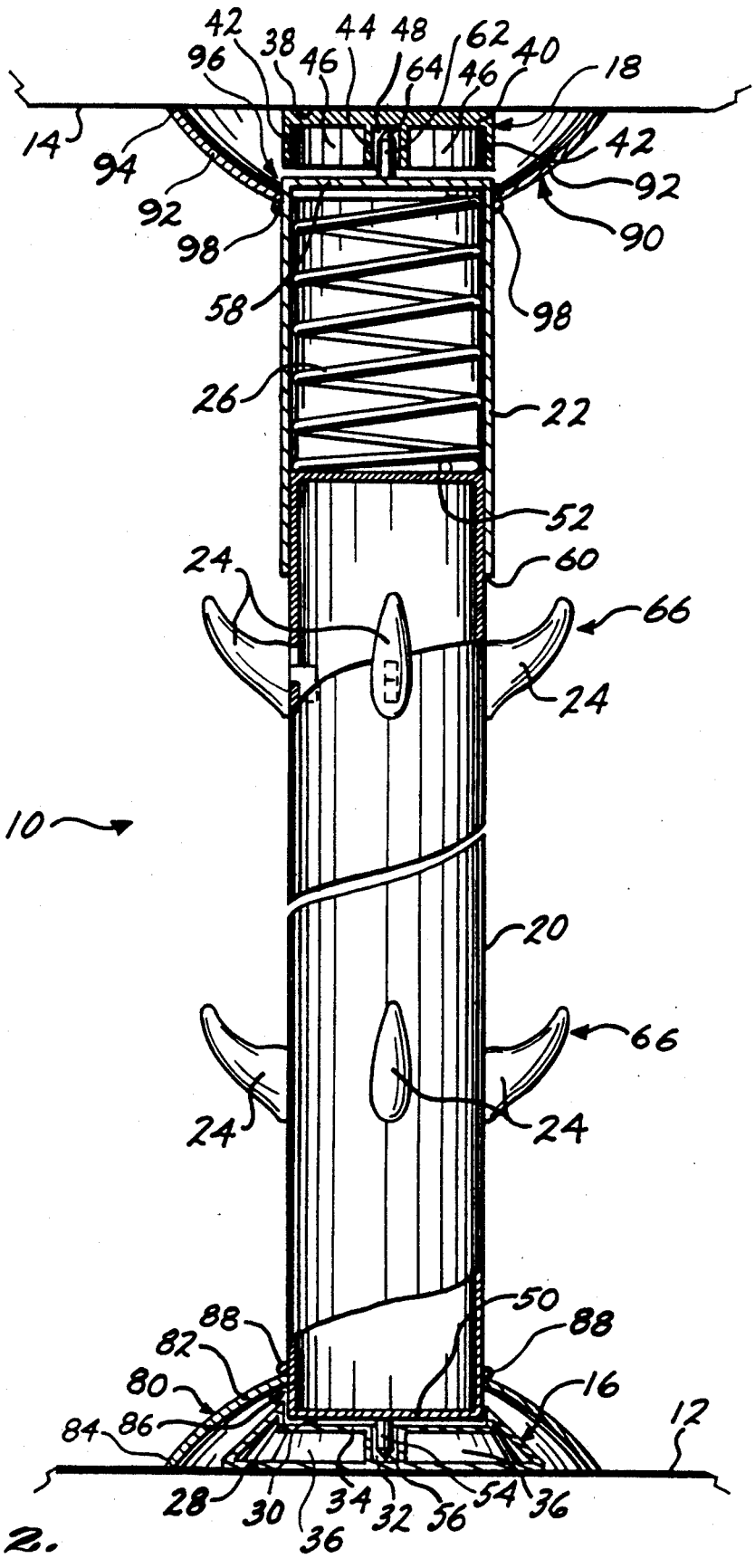
FIG. 2 is a front detail view of the shoe rack shown in FIG. 1, the front detail view being taken at its middle and partially in section to more clearly demonstrate the components making up the shoe rack.

FIGS. 1 and 2 illustrate an embodiment of the shoe rack 10 of the present invention generally including a pedestal 16, an upper mount 18, a lower tube 20 rotatably mounted to and extending upwardly from pedestal 16, an upper tube 22 rotatably mounted to and extending downwardly from upper mount 18, and a plurality of shoe support members 24 peripherally attached to lower table 20. Also included is a helical compression spring 26 that secures the lower and upper tubes together so that they rotate in unison, and that urges upper mount 18 against upper surface 14 over a range of upper surface-to-lower surface distances. Thus, a shoe rack 10 is provided that is both rotatable and extendible (or telescoping) in design.

The pedestal 16 is a frustum having a flat, circular contacting surface 28 that is placed against lower surface 12. A circular recess 30 is formed in the surface of the pedestal opposite contacting surface 28, the recess having a radial center axially aligned with the radial center of contacting surface 28. The recess 30 is of a diameter slightly larger than the outside diameter of lower tube 20, such that the recess can receive the end of lower table 20 adjacent the pedestal and can accommodate rotational movement thereof (described below). A circular pedestal bore 32 is formed in the terminal surface 34 of recess 30, such that the radial center of the pedestal bore is axially aligned with the radial centers of contacting surface 28 and recess 30. While pedestal 16 can be of solid construction, it is preferable that it be formed with hollow interior regions 36 in order to reduce the weight of the pedestal.

The upper mount 18 is of right circular cylinder configuration having a flat, circular contacting surface 38 that is placed against upper surface 14. The upper mount 18 also includes a cylindrical base 40; a peripherally located perimeter portion 42 extending orthogonally downward from base 40; and a centrally located circular portion 44 extending orthogonally downward from base 40, wherein the radial center of circular portion 44 is axially aligned with the radial center of base 40. A hollow annular region 46 is formed between the perimeter portion 42 and the circular portion 44 in order to reduce the weight of upper mount 18. A circular upper mount bore 48 is formed in the terminus of circular portion 44, thereby allowing upper tube 22 to be rotatably mounted to the upper mount 18 (described below).

The lower tube 20 is of a length that extends the majority of the distance between lower surface 12 and upper surface 14. The lower tube has a first closed end 50 disposed within recess 30 of pedestal 16, and a second closed end 52 disposed within upper tube 22. A lower pin 54 located at the radial center of closed end 50 extends downwardly from closed end 50 to be received within pedestal bore 32. The lower pin has a diameter slightly smaller than the diameter of pedestal bore 32, and has a conical terminal point 56 that permits free rotation of lower tube 20 to occur. Lower pin 54 may be integral with closed end 50 of lower tube 20, or may be attached by conventional methods.

The upper tube 22 is of a length that extends only a small portion of the distance between lower surface 12 and upper surface 14. Upper tube 22 has a closed end 58 disposed adjacent upper mount 18, and an open end 60 distal from upper mount 18 that is sized to receive a portion of lower tube 20 and to allow slidable movement between the lower and upper tubes. An upper pin 62 located at the radial center of closed end 58 extends upwardly from closed end 58 to be received within upper mount bore 48. Upper pin 62 has a diameter slightly smaller than the diameter of upper mount bore 48, and has a conical terminal point 64 that permits free rotation of upper tube 22 to occur. As with lower pin 54, upper pin 62 may be integral with closed end 58 of upper tube 22, or may be attached by conventional methods.

The helical compression spring 26 is disposed, in a compressed state, within upper tube 22 such that one end of the spring is in contact with closed end 58 of upper tube 22 and the opposite end of the spring is in contact with closed end 52 of lower tube 20. Spring 26 acts to secure lower tube 20 and upper tube 22 together so that they rotate in unison. Spring 26 also acts to urge upper mount 18 against upper surface 14, thereby holding the entire shoe rack 10 firmly in place. While the helix diameter of spring 26 has been illustrated as slightly less than the inside diameter of upper tube 22, a spring of lesser diameter may be employed provided that it is disposed within upper tube 22 in a manner that allows it to operate in the same way that illustrated spring 26 operates.

It will be appreciated that if spring 26 is operable over a range of compressibility, and if lower tube 20 extends into upper tube 22 a distance at least matching this range of compressibility, the shoe rack 10 of the present invention possesses a telescoping function, thereby making it applicable over a range of upper surface-to-lower surface distances. For example, a spring having an operable range of compressibility of approximately six inches could be employed in an eight-foot version of the shoe rack 10. Such a version of the shoe rack would be applicable in most homes, since most homes have ceilings that are within an inch or two of eight feet. It will also be appreciated that changing the overall length of the shoe rack, and/or the range of compressibility of the spring, allows the shoe rack to be employed between virtually any two surfaces.

Figure 3:
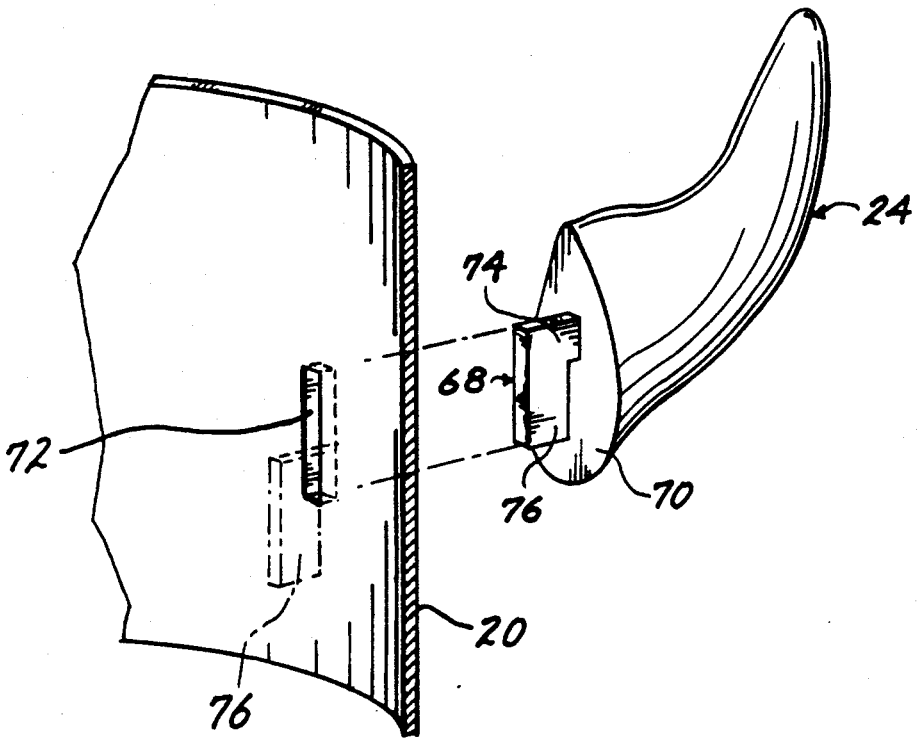
FIG. 3 is a perspective detail view of a shoe support member of the shoe rack of FIG. 1 and its manner of attachment.

Referring additionally to FIG. 3, it is illustrated that the shoe support members 24 are peripherally attached to lower tube 20 in a plurality of circumferential rows 66. Each shoe support member 24 is handsomely horn-shaped to enhance the aesthetics of the shoe rack 10, and is upwardly curved to receive and thereby support a shoe 11. It should be noted that mounting the shoe support members 24 directly to lower tube 20 provides a shoe rack that occupies a reduced volume, and is thereby more space efficient. This design also allows the heel portion of each shoe 11 to rest directly against lower tube 20, thereby providing increased stability for stored shoes.

Each shoe support member 24 includes a securing elbow portion 68 extending outwardly from a flat base 70, the securing elbow portion being sized to be received within a corresponding opening 72 in lower tube 20. Securing elbow portion 68 is of rectangular cross section and includes a first section 74 extending orthogonally outward from flat base 70, and a second section 76 integral with, but oriented ninety degrees relative to, first section 74. Thus, second section 76 is spaced from and parallel to flat base 70. When securing elbow portion 68 is inserted into opening 72 and moved downwardly until first section 74 rests against the bottom surface of opening 72, the shoe support member 24 is properly seated within the opening. The distance that second section 76 is spaced from flat base 70 substantially corresponds to the thickness of lower tube 20 such that, when shoe support member 24 is properly seated within opening 72, second section 76 rests snugly against the inside surface of lower tube 20 to hold the shoe support member firmly in place.

Each circumferential row 66 has an even number of substantially equally spaced shoe support members 24. Preferably, there are four shoe support members in each circumferential row. In this four-per-row configuration, it has been found that a lower tube 20 having an outside diameter of approximately four and one-half inches provides sufficient distance between adjacent shoe support members 24 to accommodate shoes of normal dimensions. However, as long as the fully rotatable function of lower tube 20 is not impeded, the diameter of the lower tube may be increased to hold a greater number of shoes per circumferential row.

Referring to FIG. 1, it is illustrated that the shoe support members 24 of any given circumferential row 66 are offset relative to the shoe support members in an adjacent circumferential row, such that a shoe support member of a given circumferential row is positioned at the approximate midpoint of an imaginary line 78 extending between adjacent shoe support members of an adjacent circumferential row. This full-offset configuration allows a greater number of shoes 11 to be stored per unit length of the shoe rack 10.

To improve the aesthetics of the shoe rack 10, a hollow domed member 80 is provided to cover pedestal 16 and its rotatable interaction with lower tube 20. Domed member 80 includes a continuous domed portion 82 having a peripheral base edge 84 extending about its periphery designed to fixedly contact lower surface 12. A central aperture 86 extends through continuous domed portion 82, and is sized to receive lower tube 20 and to accommodate rotational movement thereof. A bead 88, provided to hold domed member 80 in place, extends about the periphery of lower tube 20 at a position proximate to, but spaced from, closed end 50 of lower tube 20. Accordingly, that part of continuous domed portion 82 surrounding central aperture 86 rests against bead 88 to prevent translational movement of domed member 80 along lower tube 20.

Similarly, a hollow domed member 90 is provided to cover upper mount 18 and its rotatable interaction with upper tube 22. Domed member 90 includes a continuous domed portion 92 having a peripheral base edge 94 extending about its periphery designed to fixedly contact upper surface 14. A central aperture 96 extends through continuous domed portion 92, and is sized to receive upper tube 22 and to accommodate rotational movement thereof. A bead 98, provided to hold domed member 90 in place, extends about the periphery of upper tube 22 at a position proximate to, but spaced from, closed end 58 of upper tube 22. Accordingly, that part of continuous domed portion 92 surrounding central aperture 96 rests against bead 98 to prevent translational movement of domed member 90 along upper tube 22.

To further improve the appearance of the shoe rack 10, lower tube 20 and upper tube 22 may possess a wood grain finish. Since it is advantageous for the lower and upper tubes to be composed of a lightweight plastic material to thereby reduce the overall weight of the shoe rack 10 and allow easier rotation of the tubes, such a wood grain finish is best accomplished by adhering a wood grain overlay (wood veneer, photographic wood finish, etc.) to the tubes. Hollow domed members 80 and 90 may also possess a wood grain finish.

Figure 4:
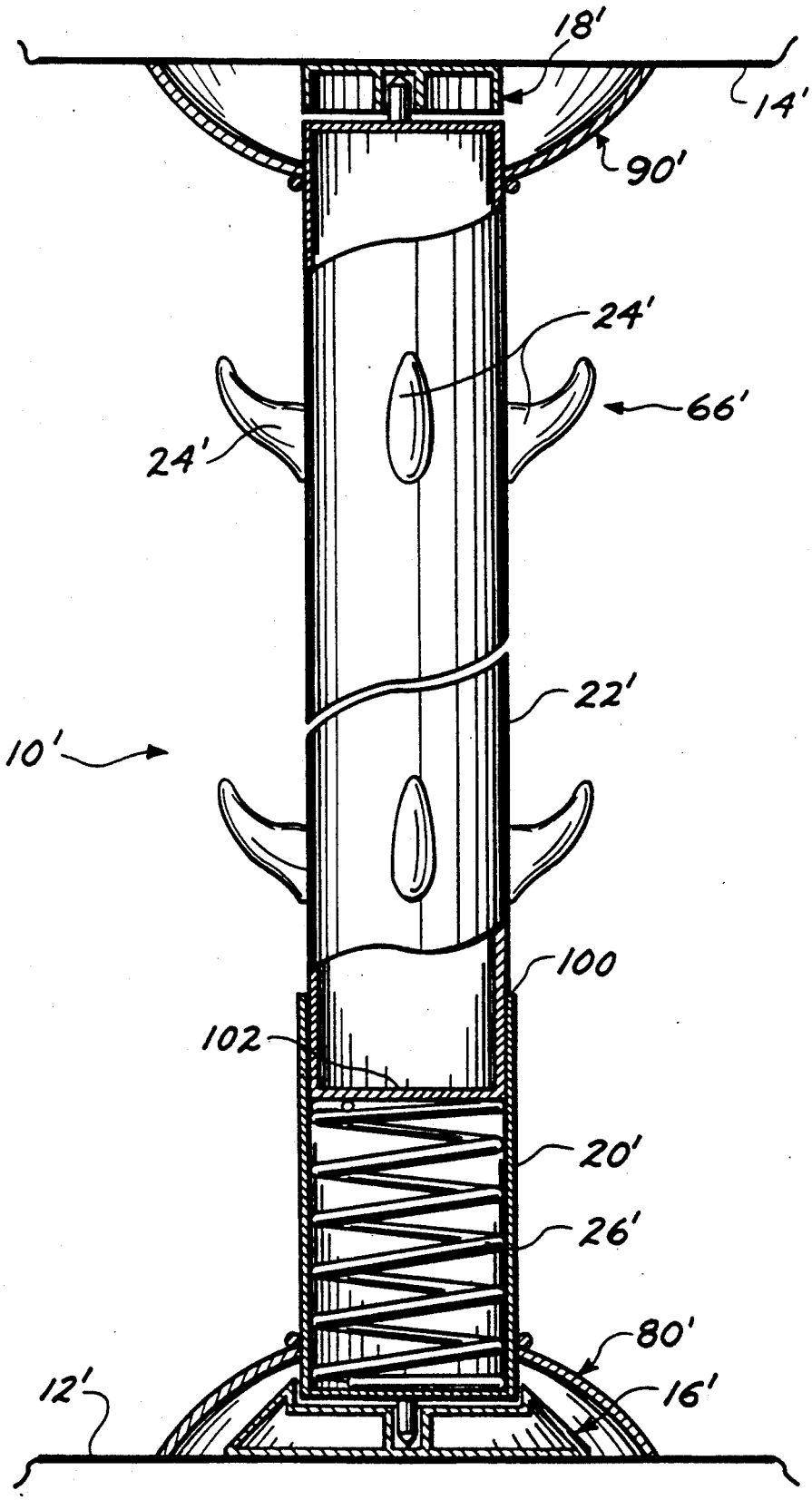
FIG. 4 is a front detail view, similar to FIG. 2, of an alternative embodiment of the shoe rack of the present invention, wherein the shoe support members are mounted to the upper tube, rather than the lower tube, of the shoe rack.

An alternative embodiment of the shoe rack of the present invention is illustrated in FIG. 4. Where structure is similar to that in the embodiment illustrated in FIG. 2, identical reference numerals bearing a prime designation have been employed in FIG. 4. As shown, the configurations of the two embodiments are virtually identical, except that: (1) lower tube 20' has an open end 100, rather than a closed end, located distal from pedestal 16'; (2) upper tube 22' has a closed end 102, rather than an open end, located distal from upper mount 18'; (3) upper tube 22' is of a length extending the predominant portion of the distance between lower surface 12' and upper surface 14'; (4) upper tube 22' is received within lower tube 20' (which is of slightly greater diameter) to allow slidable movement therebetween; (5) spring 26' is disposed within lower tube 20'; and (6) shoe support members 24' are attached to upper tube 22'. FIG. 4 clearly illustrates that this alternative shoe rack 10' operates in substantially the same manner as the shoe rack 10 illustrated in FIG. 2 and fully described above.

While preferred embodiments of the present invention have been illustrated and described, it should be understood that variations could be made therein without departing from the scope of the invention. For instance, the shoe support members could be shaped like animals (ducks, rabbits, etc.) in a children's version of the shoe rack. Further, a somewhat more expensive version of the shoe rack could have a more sophisticated means of rotation—such as a bearing assembly. Accordingly, it is to be understood that the invention is not to be limited to the specific embodiments illustrated and described. Rather, the true scope of the invention is to be determined by reference to the following claims.

The embodiments of the invention in which an exclusive property or privilege is claimed are defined as follows:

1. A shoe rack for mounting between a lower and an upper surface, comprising:

a pedestal having a contacting surface adapted for placement against the lower surface;

an upper mount having a contacting surface adapted for placement against the upper surface;

an upper tube of substantially uniform diameter rotatably mounted to and extending downwardly from said upper mount;

a lower tube of substantially uniform diameter rotatably mounted to and extending upwardly from said pedestal, said lower tube being in direct slidable engagement with said upper tube;

biasing means for securing said lower and upper tubes together so that said lower and upper tubes rotate in unison, said biasing means further urging said upper mount against the upper surface over a range of upper surface-to-lower surface distances; and a plurality of shoe support members, each being configured to support a single shoe and being directly attached to the periphery of either said lower tube or said upper tube, said shoe support members being disposed in a plurality of circumferential rows.

2. The shoe rack of claim 1, wherein:

said lower tube has a closed end distal from said pedestal and a closed end adjacent said pedestal;

said upper tube has an open end distal from said upper mount and a closed end adjacent said upper mount, said open end of said upper tube being sized to receive a portion of said lower tube and to allow slidable movement between said lower and upper tubes; and said shoe support members are attached to said lower tube.

3. The shoe rack of claim 2, wherein said biasing means comprise a helical compression spring disposed within said upper tube having one end in contact with said closed end of said lower tube distal from said pedestal and the opposite end in contact with said closed end of said upper tube.

4. The shoe rack of claim 1, wherein:

said upper tube has a closed end distal from said upper mount and a closed end adjacent said upper mount;

said lower tube has an open end distal from said pedestal and a closed end adjacent said pedestal, said open end of said lower tube being sized to receive a portion of said upper tube and to allow slidable movement between said lower and upper tubes; and said shoe support members are attached to said upper tube.

5. The shoe rack of claim 4, wherein said biasing means comprise a helical compression spring disposed within said lower tube having one end in contact with said closed end of said upper tube distal from said upper mount and the opposite end in contact with said closed end of said lower tube.

6. The shoe rack of claim 1, wherein said circumferential rows have an even number of substantially equally spaced shoe support members.

7. The shoe rack of claim 6, wherein said shoe support members of any given circumferential row are offset relative to said shoe support members in an adjacent circumferential row, such that a shoe support member of said given circumferential row is positioned at the approximate midpoint of an imaginary line extending between adjacent shoe support members of said adjacent circumferential row.

8. The shoe rack of claim 1, wherein each of said shoe support members has a securing elbow portion sized to be received within a corresponding opening in either said lower tube or said upper tube, said securing elbow portion being configured to firmly hold said shoe support member in place when seated within said opening.

9. The shoe rack of claim 1, wherein each of said shoe support members is generally horn-shaped and upwardly curved to receive a shoe.

10. A shoe rack for mounting between a lower and an upper surface, comprising:

a pedestal having a contacting surface adapted for placement against the lower surface;

an upper mount having a contacting surface adapted for placement against the upper surface;

an upper tube rotatably mounted to and extending downwardly from said upper mount, said upper tube having a closed end distal from said upper mount and a closed end adjacent said upper mount;

a lower tube rotatably mounted to and extending upwardly from said pedestal, said lower tube having an open end distal from said pedestal and a closed end adjacent said pedestal, said open end of said lower tube being sized to receive a portion of said upper tube and to allow slidable movement between said lower and upper tubes;

biasing means for securing said lower and upper tubes together so that said lower and upper tubes rotate in unison, said biasing means further urging said upper mount against the upper surface over a range of upper surface-to-lower surface distances; and a plurality of shoe support members peripherally attached to said upper tube, said shoe support members being disposed in a plurality of circumferential rows.

11. The shoe rack of claim 10, wherein said biasing means comprise a helical compression spring disposed within said lower tube having one end in contact with said closed end of said upper tube distal from said upper mount and the opposite end in contact with said closed end of said lower tube.

12. A shoe rack for mounting between a lower and an upper surface, comprising:

a pedestal having a contacting surface adapted for placement against the lower surface;

an upper mount having a contacting surface adapted for placement against the upper surface;

a lower tube rotatably mounted to and extending upwardly from said pedestal, said lower tube having a radially centrally located lower pin extending downwardly from the end of said lower tube adjacent to said pedestal;

an upper tube rotatably mounted to and extending downwardly from said upper mount, said upper tube having a radially centrally located upper pin extending upwardly from the end of said upper tube adjacent said upper mount;

biasing means for securing said lower and upper tubes together so that said lower and upper tubes rotate in unison, said biasing means further urging said upper mount against the upper surface over a range of upper surface-to-lower surface distances; and a plurality of shoe support members peripherally attached to either said lower upper or said upper tube, said shoe support members being disposed in a plurality of circumferential rows, said pedestal having a recess axially aligned with said lower tube sized to receive the end of said lower tube adjacent said pedestal and to accommodate rotational movement thereof, said recess having a radially centrally located pedestal bore sized to receive said lower pin and to accommodate rotational movement thereof;

said upper mount having a downwardly extending circular portion axially aligned with said upper tube, said circular portion having a radially centrally located upper mount bore sized to receive said upper pin and to accommodate rotational movement thereof.

13. A shoe rack for mounting between a lower and an upper surface, comprising:

a pedestal having a contacting surface adapted for placement against the lower surface;

an upper mount having a contacting surface adapted for placement against the upper surface;

a lower tube rotatably mounted to and extending upwardly from said pedestal;

an upper tube rotatably mounted to and extending downwardly from said upper mount;

biasing means for securing said lower and upper tubes together so that said lower and upper tubes rotate in unison, said biasing means further urging said upper mount against the upper surface over a range of upper surface-to-lower surface distances;

a plurality of shoe support members peripherally attached to either said lower tube or said upper tube, said shoe support members being disposed in a plurality of circumferential rows;

a lower bead extending about the periphery of said lower tube at a position proximate to but spaced from the end of said lower tube adjacent said pedestal;

a lower hollow domed member having a lower continuous domed portion, a lower peripheral base edge extending about the periphery of said lower continuous domed portion, and a lower central aperture extending through said lower continuous domed portion sized to receive said lower tube and to accommodate rotational movement thereof, said lower peripheral base edge being in fixed contact with the lower surface, that part of said lower continuous domed portion surrounding said lower central aperture resting against said lower bead to prevent translational movement of said lower hollow domed member along said lower tube;

an upper bead extending about the periphery of said upper tube at a position proximate to but spaced from the end of said upper tube adjacent said upper mount; and an upper hollow domed member having an upper continuous domed portion, an upper peripheral base edge extending about the periphery of said upper continuous domed portion, and an upper central aperture extending through said upper continuous domed portion sized to receive said upper tube and to accommodate rotational movement thereof, said upper peripheral base edge being in fixed contact with the upper surface, that part of said upper continuous domed portion surrounding said upper central aperture resting against said upper bead to prevent translational movement of said upper hollow domed member along said upper tube.

* * * * *